US005220823A

United States Patent [19]

Berg et al.

[11] Patent Number: 5,220,823

[45] Date of Patent: Jun. 22, 1993

[54] DOUBLE WALLED UNDERGROUND STORAGE TANK

[75] Inventors: Robin Berg, Hudson, Wis.; John Burwell, Eagan, Minn.; Dave Correll, Northridgeville, Ohio

[73] Assignee: Xerxes Corporation, Minneapolis, Minn.

[21] Appl. No.: 908,544

[22] Filed: Jun. 30, 1992

Related U.S. Application Data

[63] Continuation of Ser. No. 444,807, Dec. 1, 1989, abandoned.

[51] Int. Cl.[5] ..... G01M 3/04

[52] U.S. Cl. ..... 73/49.2; 220/483; 220/469

[58] Field of Search ..... 73/49.2; 220/453, 452, 220/444, 469

[56] References Cited

U.S. PATENT DOCUMENTS

| | | | |
|---|---|---|---|
| 2,725,271 | 11/1955 | Cunningham | 220/429 X |
| 3,598,275 | 5/1969 | Francois | 220/444 |
| 4,653,312 | 3/1987 | Sharp | 73/49.2 T |
| 4,685,327 | 8/1987 | Sharp | 73/49.2 T |
| 4,825,687 | 5/1989 | Sharp | 73/49.2 T |
| 4,844,287 | 7/1989 | Long | 220/429 |
| 4,974,739 | 12/1990 | Gelin | 220/452 X |
| 4,989,447 | 2/1991 | Gelin | 73/49.2 T |
| 4,993,581 | 2/1991 | Mitchell | 73/49.2 T X |

FOREIGN PATENT DOCUMENTS

| | | |
|---|---|---|
| 0351137A3 | 6/1989 | European Pat. Off. . |
| 2336318 | 12/1976 | France . |
| WO-A-8607574 | 12/1986 | World Int. Prop. O. . |

OTHER PUBLICATIONS 90114377.6-European Search Report.

*Primary Examiner*—Jerry W. Myracle

*Attorney, Agent, or Firm*—Oblon, Spivak, McClelland, Maier & Neustadt

[57] ABSTRACT

An underground storage tank is provided with a load-transmitting material in the annular space between inner and outer walls. The load-transmitting material passes aqueous liquid and the stored product and so may be used with either wet or dry alarm systems.

6 Claims, 1 Drawing Sheet

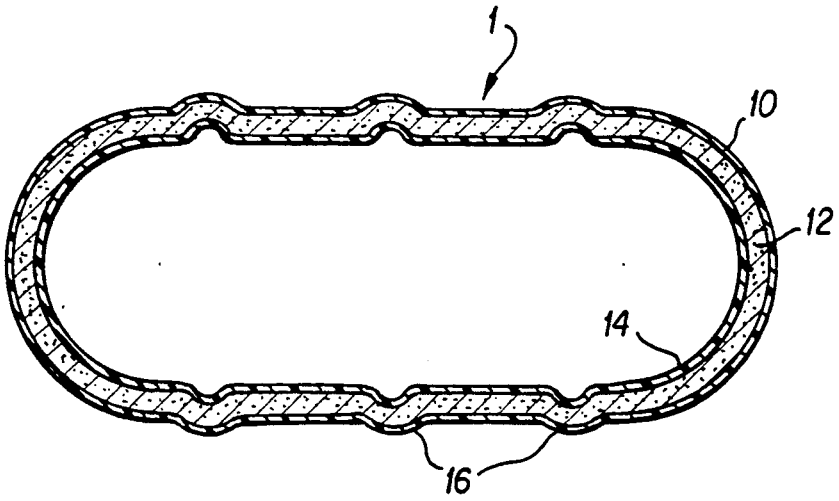
1
10
12
14
16

DOUBLE WALLED UNDERGROUND STORAGE TANK

This application is a Continuation of application Ser. No. 07/444,807, filed on Dec. 1, 1989, now abandoned.

BACKGROUND OF THE INVENTION

1. Field of the Invention

This invention pertains to tanks or containers designed to contain liquids, underground, for dispensing. Specifically, a double walled tank, for the containment and dispensing of petroleum products, is addressed.

2. Background of the Prior Art

By far the dominant method of storing and dispensing liquids, particular petroleum products, from, e.g., service stations, is through the use of underground storage tanks. Conventionally, tanks, of generally cylindrical design, are prepared and installed in a pit, subsequently covered, said tanks having been provided with fittings, piping, valves and the like, such that gasoline or similar fuel products can be introduced to the interior of the tank, and then dispensed, under control. Initially, these tanks were prepared from steel. Steel continues to be a popular material from which to construct the storage tanks.

However, as discussed in U.S. Pat. Nos. 3,335,904 and 3,700,512 the problems associated with underground storage tanks, particularly posed by corrosion problems, and the crushing pressures applied, particularly if the hole should become filled with water, require for many situations the use of a superior material, such as fiber reinforced plastic, a particular example of which includes chopped fiberglass reinforced isophthalic resin. Note, in particular, the discussion at column 1, lines 64–72 and column 2, line 60—column 3, line 8 of U.S. Pat. No. 3,335,904 and particularly the discussion at column 2, lines 4–65 of U.S. Pat. No. 3,700,512.

In this respect, it should be noted that underground storage tanks, and factors addressed in their design, production, and maintenance, should be distinguished from containers intended for above-ground storage, such as for the storage and/or transportation of cryogenic materials. While both types of containers must have sufficient strength to contain the liquid in the interior, these cryogenic containers are generally constructed without regard to, or need to safeguard against, pressures and corrosive agents applied from the exterior, as in the case with underground storage tanks. U.S. Pat. Nos. 3,895,152 and 3,317,074 are exemplary references discussing cryogenic containers.

However, the use of fiber reinforced plastic materials for the construction of underground storage tanks has not totally eliminated the problem of environmental contamination or pollution. In particular, the tanks of the prior art, although exhibiting superior resistance to corrosive attack, nonetheless remain potentially subject to cracking and/or holing, particularly during handling, as well as after installation. For example, the rough treatment a tank may receive during transportation and manipulation prior to installation may result in undetected punctures of the tank. Similarly, when in operation, a shift in the bed may result in fracturing or holing of the tank, resulting in the spillage and resulting hazards addressed in U.S. Pat. No. 3,700,512.

Accordingly, many locations and authorities have instituted heightened standards for reliability for the construction and design of underground storage tanks, such as Calif. Even in regions where such stringent regulations are not enforced, avoidance of environmental pollution remains a concern of the highest priority.

One widely adopted response to this problem has been the provision of dual-walled storage tanks. An example of a double walled storage tank prepared from steel materials can be found in U.S. Pat. No. 1,886,074. However, as noted above, steel rusts. Double walled underground storage tanks have also been prepared out of fiber reinforced resin systems, such as that disclosed in U.S. Pat. No. 4,676,093. As described in both these references, the provision of two walls, alone, is insufficient. The use of a double walled storage tank is adopted to allow the installation of an alarm system, which will detect a leak in either the inner tank, the outer tank, or both. One such alarm system consists of detectors sensitive to the presence of fluid in the space between the inner and the outer tank. This is generally referred to as a "dry" alarm system. An alternative, or "wet" system, fills the space between the inner and the outer tank with a liquid, such as ethylene glycol, water or brine. When either the inner or the outer tank is punctured or otherwise develops a leak, at least a portion of the liquid contained between the two tanks will flow through the leak, the reduction in the volume of water held between the two walls being detected, by a variety of responsive means. Such systems again are described in U.S. Pat. No. 4,676,093, as well as U.S. Pat. No. 4,672,366.

However, the need to maintain a space between the inner and outer tanks of a double walled storage tank implies that two separate, strong tanks be constructed, and connected. In U.S. Pat. No. 4,676,093, as well as many other references, such as U.S. Pat. No. 4,739,659, this is achieved by the provision of ribs which extend between the first and second tank, providing contact therebetween, as well as circumferential reinforcement and deflection resistance. However, even in the design in U.S. Pat. No. 4,739,659, a certain amount of space between the inner and the outer wall must be left open, for the alarm or leak-detection system. This patent includes a "gas pervious" material between the inner and outer walls, the outer wall being discontinuous, tied into the side of each rib. The gas pervious material is not load-transferring, and strength is again provided by securing the outer tank wall to the ribs. Since both tanks have to be resistant to leakage or penetration, this implies that both tanks must have, independent, sufficient strength to resist puncture, fracture and compression, as they cannot share strength, no load being transmitted across the space between the two tanks, save for the limited case of the ribs. While the presence of the ribs may be employed to reduce deflection therebetween, spacing of the ribs does not permit a load or impact at a point between the ribs applied to, e.g., the outer tank, to be transmitted to, or shared with, the inner tank. Similarly, loads or impact supplied to the inner tank, cannot be shared by the outer tank. This results in independently strengthened inner and outer shells, and a significant consumption of material and man hours.

Accordingly, it is an object of this invention to provide a double walled tank, capable of being equipped with either a dry or wet alarm system, which comprises a inner and outer shell, between which load may be transmitted and shared, so as to reduce the need to provide two entirely independent tanks, and reduce the material, and man hours, involved in their construction.

SUMMARY OF THE INVENTION

The above objects, as well as others that will be discussed in detail, below, is achieved by providing two independent rigid shells, as in prior art tanks, but filling the space therebetween entirely with a load transmitting, resin impregnable, water-passing substance. The substance that fills the space between the two tanks must be capable of transmitting load across the distance between the two tanks. In order for the load-transmitting material to transfer load in the direction normal to a first shell and to the opposed face, said material can be fixed in position by adherence to the shells, when possible, or by close contact with the outer surface of the inner shell and the inner surface of the outer shell. Since, conventionally, these tanks are made of fiber-reinforced resin materials, an ideal method of securing the load-transmitting material to the walls of the tanks is to apply resin thereto, and cure it up against the tank. Ideally, therefore, the material should be capable of taking up resin, and curing against the tank. To be capable of being equipped with a dry alarm system, the resin infiltrated load-transmitting material should be capable of passing petroleum liquids. That is, within a relatively short period of time, regardless of the point of the leak on the interior tank, the petroleum products stored therein should be capable of passing along the space between the two tanks, through the load-transmitting material, to the bottom of the tank, under the influence of gravity, to contact the dry alarm system situated thereat. In order to equip the tank with a wet alarm system, the load-transmitting material must be capable of water passage therethrough, i.e., in the ideal state, a continuous liquid, preferably aqueous, phase must be present in the load-transmitting material, without loss of load-transmitting characteristics.

One exemplary material for the load-transmitting filler is an non-woven composite felt or system, produced by Ozite Corporation, of Ill., under the name Compozitex TM. This material is conventionally sold as a structural element, for use, e.g., in the preparation of insulation and the like. It is selected for use in this invention because of its combination of load-transmitting capabilities, its easy impregnation, adherence and curing with resin, and its transparency to water, or stored petroleum products. In this regard, such products should be porous. Compozitex TM is apparently made sufficiently porous by needling.

Other, similar materials, generally manufactured for use in building insulation and the like, are available from other manufactures. This invention is not limited to any specific load-transmitting material.

A double walled tank, meeting the most stringent current safety regulations, prepared with an intermediate layer of Compozitex TM can be prepared reducing the amount of materials in the outer shell by half.

BRIEF DESCRIPTION OF THE DRAWING

The FIG. is a representational plan view of an underground storage tank, bearing external ribs, and a load-transmitting substance filling the space between inner and outer shells.

DETAILED DESCRIPTION OF THE INVENTION

The underground storage tank of this invention is broadly illustrated in the FIG. It consists of an outer tank, 10, comprised of chopped fiberglass-reinforced resin, which has been cured up, of similar or identical composition to inner tank wall 14. Lying between, and adhered to both walls, is the load-transmitting material 12, entirely filling the annular space between tank walls 10 and 14. Ideally, these tanks bear external ribs 16, for reinforcement, and to prevent deflection. The number, and placement, of ribs 16, will vary with tank diameter and length.

Outer shell 10 can be prepared through a female molding process, such as that disclosed in U.S. Pat. No. 4,363,687, the entire content of which is incorporated herein, by reference. Briefly, a half mold, corresponding to the topography of one-half of the length of tank 1, is provided with an internal lining or release agent, making detachment of the mold from the finished shell possible. On the internal wall of the female mold, a mixture of discontinuous fibers, generally a fiberglass roving or similar material, and resin, is blown or sprayed onto the internal wall. Generally, the resin is in the form of a liquid mixture, also containing a catalyst, for auto-curing of the mixture. In one preferred embodiment, the female mold is caused to rotate about its longitudinal axis, while the wall material is sprayed from a central position, which passes along the length of the mold.

Pursuant to the current invention, once this external shell is formed, a layer which is either pure resin, or extremely resin rich, is sprayed upon the interior of the formed wall. This is semi-cured, to a tacky condition, at which time the load-transmitting material, such as Compozitex TM, is applied thereto. As this material is a workable felt, which can be provided in long strips, sheets, etc., it is a straightforward operation simply to place the load-transmitting material against the tacky wall, and then roll out air pockets between the felt and the outer wall, with a conventional roller, similar to those used in painting and the like. As noted previously, the load-transmitting material quickly takes up the resin, and is adhered to the outer tank thereby.

Other load-transmitting materials may be used, such as composite honeycomb or plastic webbing. A particularly preferred webbing is available as an extruded net or webbing having continuous passages therethrough. One supplier of such material is the Conwed Corporation of Minneapolis, Minn. If the material is thermoplastic it may be necessary to alter its surface properties to adhere to the resin of the tank. Similar load-transmitting materials may be used.

Once the load-transmitting material is secured against the outer tank, the molding process is resumed, with a first layer of resin or resin rich material applied against the internal surface of the load-transmitting material, to ensure bonding of that phase to the outer surface of the internal wall 14. The internal wall 14 is then similarly sprayed up, and the two halves are joined, as is conventional in the art. It should be noted that ribs 16 may be prepared according to conventional processes. If there is no manway provided, and the two molded tank halves are mated only from the outside, care must be taken to ensure the annular material 12 is continuous across the joint.

It should be noted that adhesion of the load-transmitting material to the sides of the tank shells is unnecessary to achieve transmission of the applied load in a direction normal to the surface to which the load is applied. The configuration of the tank fixes the material in position. Since the tank, in use, is generally under compression, load will be transmitted across the material. Adhesion of the material to the outer surface of the inner wall and inner surface of the inner wall does impart shear resistance not otherwise obtained, and accordingly remains a preferred embodiment.

Alternatively, the double wall tank of this invention can be prepared through a male molding process, such as that described in U.S. Pat. No. 4,676,093, column 2, line 11—column 3, line 4. It should be noted that, unlike that prior patent, there is no need to provide or maintain holes in ribs, or specific passageways. In the claimed invention, the load-transmitting material extends between the rib surfaces of the external and internal shell, and accordingly, where a wet alarm system is desired, the alarm liquid passes through this layer.

Whether prepared through a female or male molding process, the resulting double wall tank has significantly greater strength against compression than prior double wall tanks, in regions between the ribs of the tank cylinder. Specifically, the outer and inner shell, by virtue of the load-transmitting material therebetween, now act together, in resisting applied force. Thus, to secure a tank of strength equal to prior art embodiments where the outer and the inner tank must necessarily be of independently sufficient strength and thickness, one can prepare a tank according to the claimed invention, where the thickness of at least one of the two shells is reduced to that of a liner. Alternatively, the thickness of both shells may be reduced sharply to provide a symmetrical system. In any event, the total consumption of material is significantly reduced over currently available systems. Thus, in one embodiment, the internal shell 14 has a thickness of about 3/16 inch, the load-transmitting material has a thickness of about a $\frac{1}{8}$ inch, and the exterior tank has a thickness of about $\frac{1}{4}$ inch. These dimensions are exemplary only. It is possible to vary thickness in both directions and maintain a generous safety factor. As the cost of the load-transmitting material, and the labor involved in its application, is sharply lower than that of the exterior tank 10, this reduction in material constitutes a significant reduction in cost of the tank, both in terms of material used, and labor required.

The total annular space is sharply reduced in the invention, over prior art systems. Thus, using Compozitex TM, a total value of perhaps 270–300 gallons is required to fill the space of a 10,000 gallon tank, as opposed to 1,000 gallons or more for prior art systems. Additionally, since the annular space is continuous, the entire tank can be monitored by one alarm means, without the need to provide passageways through the ribs, as envisioned in U.S. Pat. No. 4,739,659. In general, the volume will range from 100–300 gallons. This is not only more economical, it renders the system with a wet alarm more sensitive to leakage. Moreover, a storage tank of this design can be shipped from the factory with its annulus filled, a great advantage over prior systems.

Where a dry alarm system is desired, a leak sensor such as that described in U.S. Pat. No. 4,672,366 may be employed. Alternative systems may be used. In U.S. Pat. No. 4,672,366 a sensor cable, comprised of a twisted pair of conductors separated by insulation materials is placed at the bottom of the tank. The insulating materials are specially designed to degrade in the presence of petroleum products, such as gasoline and diesel fuels, or other materials to be stored in the tank such as machine oil, and the like. If the inner tank develops a leak, as noted above, the stored petroleum products will pass easily through the load-transmitting layer, under the influence of gravity, to the bottom, where the insulation material will be contacted, and degraded. This causes a change in resistance in the twisted cable, and eventually, a short circuit, which sets off an alarm.

Alternatively, a wet alarm system, such as that described in U.S. Pat. No. 4,676,093, can be employed. Wet alarm systems are capable of detecting leaks in either the outer shell 10 or the inner shell 14, or both. An exemplary system is described in U.S. Pat. Nos. 4,676,093 and 1,996,074. In such a system, the space between the inner and outer tank is completely filled with a freely flowing liquid, such as ethylene glycol, water or brine, which may be given a distinctive color, odor, etc. The fill line for this space rests above the installation, and can be visually or electronically monitored. In operation, the space is filled, and the column leading to this space is similarly filled to a predetermined level, above the tank, which may be monitored. Should a leak develop in either the inner or the outer tank, the level in the standpipe will drop in response thereto, signaling a need for immediate repairs. It is also possible to use a specific liquid for the detection material which can cause a sensor in the interior of the tank to respond, if desired. It is, of course, critical that the liquid solution of the wet alarm system be able to freely move in the annular space, and the load-transmitting material of this invention allows such movement.

Of course, fittings for filling the interior tank, vapor recovery, level measuring, a manway, if desired, etc. are provided on and through the two tanks. Such fittings are well described in the art, and constitute no part of this invention, per se.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the U.S. is:

1. A double walled underground storage tank for the containment of petroleum products, comprising:

an outer rigid shell comprised of reinforced resin material, an interior rigid shell of shape similar to, but smaller than, that of the exterior shell, said inner shell being comprised of reinforced resin materials and spaced from said outer shell so as to create an annular space therebetween, said annular space occupied by a loadtransmitting material fixed in position between and adhered to the inner face of said outer shell and the outer face of said inner shell, such that it is capable of transmitting load between said shells, said loadtransmitting material being of a nature such that liquids will flow therein.

2. The underground storage tank of claim 1, wherein said annular space is provided with a dry detection system, for detecting the presence of said petroleum products in said annular space, said load-transmitting material being so constructed such that said products will flow from any point in said annular space to said detection system.

3. The underground storage tank of claim 1, wherein said storage tank is provided with a wet alarm system, comprising a liquid material filled in said annular space and freely flowing through said loadtransmitting material, further comprising a fill pipe extending from said annular space to a point above said tank, said liquid, in operation, extending up said fill pipe, to a level which is monitored.

4. The underground storage tank of claim 3, wherein said liquid material has a total volume of 100–300 gallons.

5. The underground storage tank of claim 1, wherein said load-transmitting material is comprised of a felt of mineral wool, which is sufficiently porous such that liquid will pass therethrough.

6. The underground storage tank of claim 1, wherein said load-transmitting material is selected from the group consisting of fiber felts, webbing and honeycomb-shaped material.

* * * * *